United States Patent [19]

Shaw et al.

[11] Patent Number: 4,669,651

[45] Date of Patent: Jun. 2, 1987

[54] MULTI-POCKET ENVELOPE HAVING DISPLACED POCKETS OF UNIFORM SIZE

[76] Inventors: James K. Shaw; Fanny L. Shaw, both of 4916 Erie St., Annandale, Va. 22003

[21] Appl. No.: 725,789

[22] Filed: Apr. 22, 1985

[51] Int. Cl.[4] ..... B65D 25/00

[52] U.S. Cl. ..... 229/1.5 R; 229/DIG. 14

[58] Field of Search ..... 229/1.5 R, DIG. 14, 229/72, 71; 40/359, 124.2; 383/40, 103; 211/55; 206/44 B, 425

[56] References Cited

U.S. PATENT DOCUMENTS

| | | | |
|---|---|---|---|
| 282,275 | 7/1883 | Cooke, Jr. | 229/72 |
| 314,598 | 3/1885 | Meek | 229/72 |
| 314,598 | 3/1985 | Meek . | |
| 574,974 | 1/1897 | Wiley | 229/72 |
| 1,552,303 | 9/1925 | Hubbard | 229/72 |
| 1,564,557 | 12/1925 | Greenhaus | 229/72 |
| 2,793,743 | 5/1957 | Lefebvre | 383/40 |
| 3,062,217 | 11/1962 | Woodhouse, Jr. | 40/359 |
| 3,133,691 | 5/1964 | Corbett | 229/DIG. 14 |
| 3,818,963 | 6/1974 | Whitman | 383/40 |
| 3,944,132 | 3/1976 | Caprile et al. . | |
| 4,444,314 | 4/1984 | Jacobsson | 206/425 |

FOREIGN PATENT DOCUMENTS

| | | | |
|---|---|---|---|
| 639709 | 4/1962 | Canada | 229/DIG. 14 |
| 590118 | 4/1932 | Fed. Rep. of Germany | 229/1.5 R |
| 858658 | 1/1961 | United Kingdom | 40/359 |

*Primary Examiner*—Stephen P. Garbe

*Attorney, Agent, or Firm*—Lowe, Price, Leblanc, Becker & Shur

[57] ABSTRACT

A multi-pocket envelope which may be used for organizational storage of financial records, tax receipts and the like, includes a number of pockets vertically displaced from one another to provide easy visibility of identifying indicia thereon and easy access to contents thereof. The vertically displaced pockets include vertically displaced bottom portions in order to provide substantially uniform depth for each of the pockets and to enable storage of documents of the same dimension in each of the pockets with equal ease of access.

23 Claims, 8 Drawing Figures

MULTI-POCKET ENVELOPE HAVING DISPLACED POCKETS OF UNIFORM SIZE

TECHNICAL FIELD

This invention relates to multi-pocket envelopes, and more specifically to multi pocketed envelopes wherein the pockets are vertically displaced from one another in order to display identifying indicia for the contents thereof.

BACKGROUND ART

Multi pocket, accordion type envelopes are well known in the art, as illustrated by U.S. Pat. No. 1,585,237 to Doughty and by Hoffmann U.S. Pat. No. 2,756,515. Both the above described patents provide identifying indicia for contents stored in the several pockets of the envelope. The indicia are provided as printed identification at an upper portion of each of the pocket separators. The portion bearing the identifying indicia may be raised, as shown in the Doughty disclosure.

Access to the contents of an individual pocket may be difficult, requiring manipulation and separation of adjacent pocket separators, however, since all separators have a common height. As shown in U.S. Pat. No. 314,598 to Meek, an accordion-type envelope for holding blanks may be provided with graduated heights for the several pockets thereof. However, where such a structure is utilized for storage of files of identical physical dimensions, materials stored in pockets having a greater depth are placed more deeply in the pocket, thus resulting in an increased likelihood of non-access to a desired file.

Similar problems arise in the multi pocketed envelope described in Caprile et al., U.S. Pat. No. 3,944,132, wherein pocket separators for successive pockets are shown to have successively increasing height, thus providing successively increasing pocket depth.

In a multi-pocketed filing receptacle described in Greenhaus U.S. Pat. No. 1,564,557 there are shown a number of pocket separators of substantially equal height, vertically displaced from one another, to form a plurality of pockets. The pockets have a common bottom portion, however, each separator permitting the pocket contents to fall into the common bottom portion.

McCleneghan U.S. Pat. No. 3,266,712 teaches a mailing envelope structure having two pockets. One of the compartments has a selectively variable size, in which variation is achieved by selective application of adhesive. Similarly, in a banking envelope described in Tulisalo U.S. Pat. No. 3,642,195 there are provided a side opening currency pocket and a flap closed end opening coin pocket, the bottom of the coin pocket being spaced above the lower end of the envelope.

Several multi-compartmental envelopes are known in the art to have affixed indicia for identifying particular uses thereof. For illustrative purposes reference is made to the Falcon U.S. Pat. No. 3,850,083 wherein a receipt folder is provided primarily for receipts of significance to tax records. The folder includes a number of slits in a book-like structure, the slits opening to a plurality of pockets into which the receipts may be placed. Each of the pockets is identified by indicia defining the contents thereof. Casas et al., U.S. Pat. No. 3,839,809 describes a similar book-style arrangement of a plurality of envelopes for maintaining personal records. Each of the envelopes is identified by indicia descriptive of the time period for the records stored therein, and a summarizing label is provided for the entire folder summarizing the entire contents thereof.

None of the prior art discloses a pocketed envelope for storage of substantially identically sized documents in a plurality of pockets which are vertically displaced from one another in order to provide ease of access to the documents and which, at the same time, will provide the documents at the same grasping distance from the top of the pockets. Thus, where a plurality of pockets are provided in the prior art, either the pockets are of substantially the same height at no vertical displacement, thus increasing the difficulty of accessing a particular pocket or, alternatively, the pockets are vertically displaced to enable ease of access to a particular pocket, but the contents of such vertically displaced pockets are themselves at substantially a common elevation thus increasing the difficulty of accessing the documents within the pockets.

Additionally, there is not available in the prior art a particular tax record keeping system which enables an easily stored set of documents to be easily retrieved from a plurality of vertically displaced pockets in an accordion-type of multi-pocketed envelope.

DISCLOSURE OF INVENTION

It is accordingly an object of the present invention to overcome the difficulties of the prior art and to provide a multi-pocketed envelope which is structured to provide ease of access to the pockets and ease of access to the documents stored within the pockets.

It is an additional object of the invention to provide a multi-pocketed envelope in which a plurality of pockets, of substantially identical dimensions, are vertically displaced from one another.

Still another object of the invention is the provision of a multi-pocketed envelope in which both the upper and lower edges of the pockets are vertically displaced from one another.

Still a further object of the invention is the provision of a multi-pocketed envelope having a plurality of vertically displaced pockets which include passageways between the pockets permitting air to enter the pockets during expansion of the envelope and to leave the pockets during compression of the envelope.

Still another object of the invention is the provision of a multi-pocketed envelope in which there is provided a transparent pocket for insertion of a preprinted summary of information pertaining to the envelope for display to a user.

It is a more specific object of the invention to provide a tax record keeping system in which a multi-pocketed envelope includes a plurality of pockets vertically displaced from one another to permit easy access to the pockets and to the documents stored therein.

Yet another object of the invention is the provision of a tax record keeping system in which identification of the contents of each of a plurality of pockets is provided by indicia preprinted on upper portions of the pockets, along with a guide indicating the proper utilization of the various pockets.

It is a further object of the invention to provide a multi-pocketed envelope for record keeping purposes in which the contents of each of the pockets are identified by indicia provided on removable labels associated with top portions of the plurality of pockets, each of which are vertically displaced from one another.

Yet another object of the invention is the provision of a multi-pocketed envelope for record keeping purposes, in which the plurality of pockets are vertically displaced from one another and in which removable labels are provided on a backbone structure applied to the top portions of the pockets.

In accordance with these and other objects of the invention which will become more readily apparent upon analysis of the description hereof, there is provided a multi-pocketed envelope including a plurality of pockets having upper and lower portions respectively vertically displaced from one another in a common direction.

More specifically, the invention provides for a plurality of pockets formed by vertical separators forming top and bottom portions of the pockets, the separators arranged to provide the upper and lower portions of adjacent pockets with a vertical separation from one another. In accordance with one embodiment, the vertical separators may be of differing sizes and may include bottom-portion forming elements provided at different distances from the separator bottoms in order to form bottom portions of the pockets at different displacements from the bottom of the envelope.

The vertical separators providing the top and bottom portions of the pockets further provide for air passage between adjacent pockets in order to facilitate expansion and compression of the envelope.

In accordance with another aspect of the invention, there is provided a multi-pocketed envelope incorporating a plurality of pockets having a substantially common depth dimension in which the pockets are vertically displaced from one another.

Yet another feature of the invention provides for preprinted indicia associated with the top portions of each pocket for identifying the contents of the pocket. Preferably, the preprinted indicia are provided on backbone-like structures mountable on the upper portions of separators forming the pockets.

Still another feature of the invention provides for preprinted indicia on a single surface of the envelope, identifying the contents and use of a plurality the pockets provided therein. Preferably, a transparent pocket is provided for insertion of a sheet of printed material identifying the contents and use of the plurality of pockets.

In a preferred embodiment, the invention provides a multi-pocketed envelope having vertically displaced pockets of substantially identical size for maintaining and storage of substantially identically sized documents in a tax receipt organizing system. Each of the pockets is labelled with one or more tax categories for identification and storage of documents associated with the identified categories. Further, the envelope includes preprinted information on one surface thereof summarizing the contents of each pocket and the utilization thereof.

BRIEF DESCRIPTION OF THE DRAWINGS

The foregoing and other objects, features and advantages of the invention will become more readily apparent upon reference to the following detailed description of the best mode for carrying out the same, when taken in conjunction with the accompanying drawings in which.

BEST MODE FOR CARRYING OUT THE INVENTION

Figure 1:
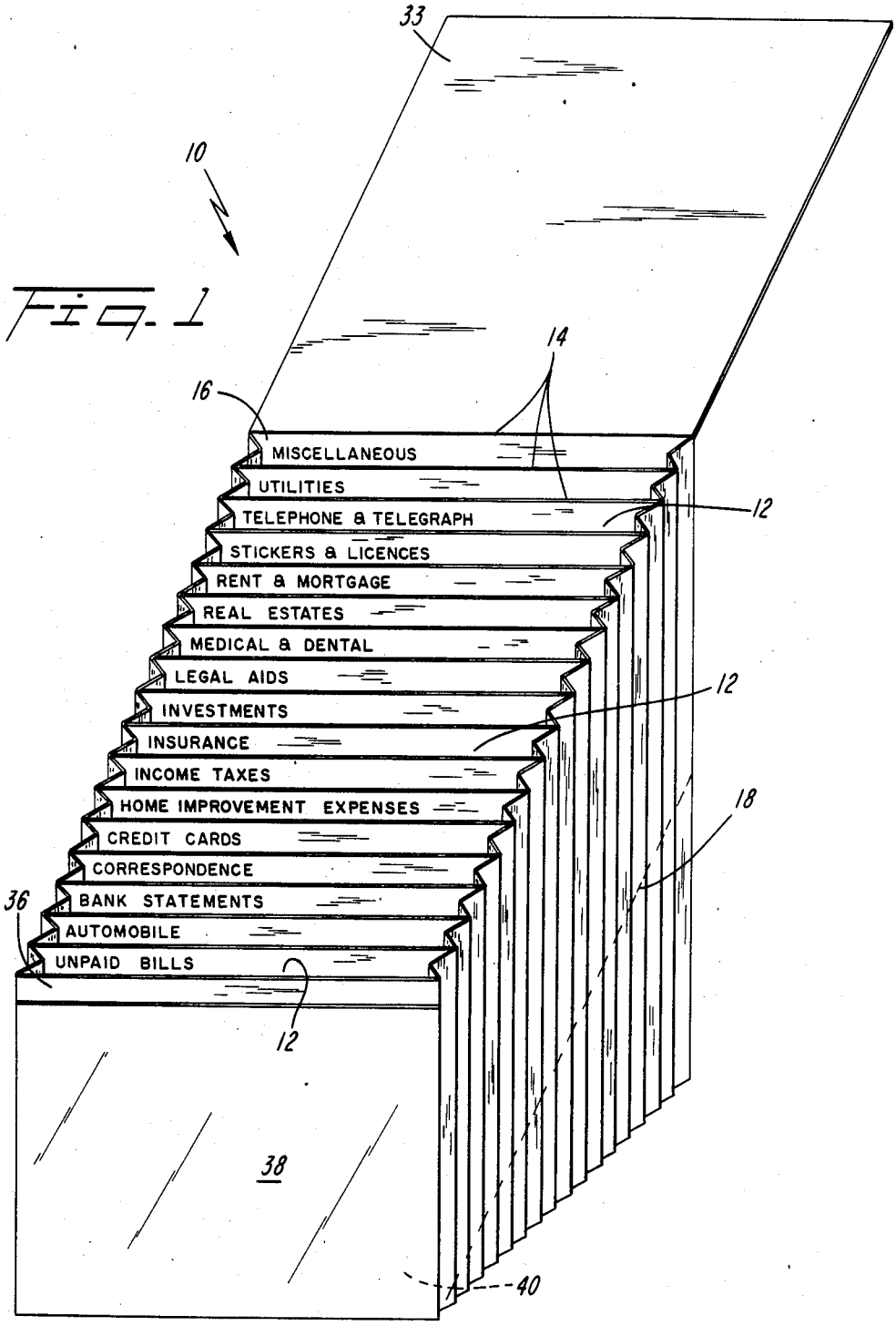
FIG. 1 shows a perspective view of the invention.

Referring now to FIG. 1, there is shown a perspective view of a multi-pocketed expandable (accordion type) envelope in accordance with the invention. The envelope is generally identified by reference numeral 10.

As seen therein, envelope 10 includes a number of pockets 12, having upper portions 14 which are vertically displaced from one another for ease of access to the pockets and for enhanced visibility of identifying indicia 16 provided thereon. Thus, the pockets of the envelope provide a staircase appearance.

The inventive envelope is preferably intended for use in storage of records for tax purposes. However, other types of files may be stored in similar envelopes. For tax record-keeping purposes, an individual typically prepares a number of sheets of standard size paper, such as $8\frac{1}{2}'' \times 11''$ paper, each including a number of income or expense figures thereon. When used for other purposes, other standard sized paper may be used, such as $3'' \times 5''$ index cards, for example.

A significant advantage of the present invention is the ease of access provided to the contents of the various pockets 12.

In a staircase type of multi-pocketed envelope, when the contents of the various pockets are of a common size as hereinabove described, the contents of the frontward pockets are located more closely to the upper portions 14 thereof than are the contents of the rearward pockets. Thus, an attempted access to the contents of a rearwardly located pocket is more likely to result in error since it is more likely that the sheet of paper contained therein will elude the grasp of the user. In other words, because of the neccessity for reaching more deeply into a rearward pocket in order to grasp its contents, the posibility that the contents may not be grasped is greater than for the contents of a forwardly located pocket.

Advantageously, the present invention provides pockets of common depth, thereby reducing the possibility of erroneous access to the rearward pockets. Each of the pockets in the envelope according to the invention is thus of the same depth, and the contents of the rear-most pocket are no further from the upper portions 14 thereof than are the contents of a frontwardly located pocket.

The common pocket depth is illustrated in FIG. 1 by line 18, representing the bottoms of each of the pockets 12.

The present invention thus provides a multi-pocketed envelope in which both the upper and lower portions of the pockets are vertically displaced from one another.

The upper portions are vertically displaced in order to enhance accessibility to the pockets, while the lower portions are similarly vertically displaced to enhance accessibility to the contents of the pockets by providing the same grasping distance for each pocket.

Figure 2:
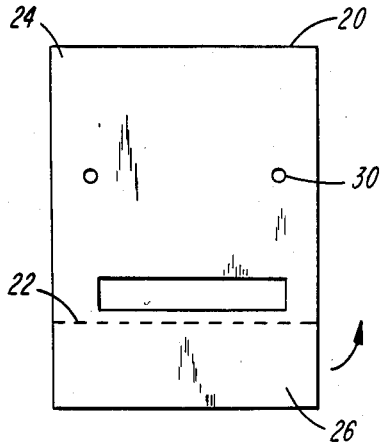
FIG. 2 shows a view of a separator which may be used in FIG. 1.
Figure 3:
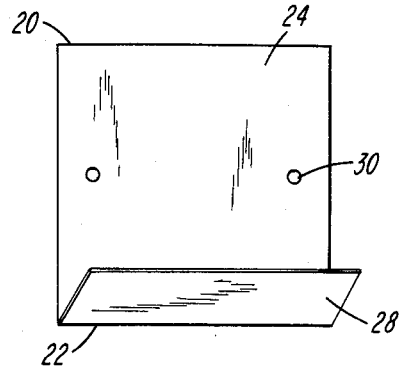
FIG. 3 shows the separator of FIG. 2 folded in accordance with the invention.

Referring now to FIGS. 2 and 3, there is shown a structure for a vertical separator 20 between pockets. The illustrated separator may be used to provide the vertical displacement for both the upper and lower portions of the various pockets.

As shown in FIG. 2, separator 20 is provided with a fold 22 at a predetermined distance from a top portion 24 thereof. A bottom portion 26 is upwardly folded at the fold 22 to form the bottom of a pocket defined in part by the separator 20. Preferably, adhesive material is applied to a rear surface 28 of bottom portion 26. After folding of the bottom portion, it will be recognized that the rear surface 28 is forwardly exposed, as shown at FIG. 3.

Each of the substantially identical separators is inserted in the envelope at an appropriate vertical displacement and is attached thereto in a standard manner in order to form the various pockets. Upon adhesive attachment of forwardly facing rear surface 28 of one separator to the rear surface of the next forwardly placed separator, the bottom of the pocket formed therebetween is defined.

Thus, the vertically displaced upper portions 14 of the pockets 12, as well as the vertically displaced lower portions thereof, are formed by the vertically displaced separators 20. Accordingly, vertical separators of a standard size may be used to provide vertically offset pockets of a substantially identical vertical depth for retaining contents of a fixed size.

Of course, the fold 22 may be provided as a manifold structure (not shown), in order to enhance expansion and compression of the pockets. Additionally, the top portions 24 of the various separators may include label affixation areas projecting vertically therefrom at various horizontal displacements in order further to enhance visibility of and access to the pockets.

Yet another feature of the invention is the provision of a number of inter pocket passageways, shown as holes 30 provided in the separators 20.

The holes 30 provide passageways for air between adjacent pockets and thus through the envelope. Thus, the present invention provides an enhanced compression and expansion of the envelope upon closure or opening of the same by permitting ready passage of air out of and into the pockets, respectively.

Figure 7:
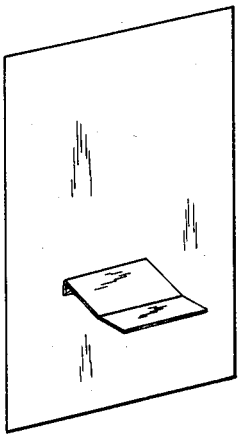
FIG. 7 shows a separator incorporating a V-shaped attached flap structure.
Figure 8:
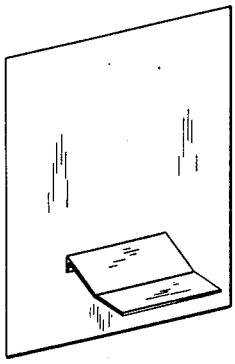
FIG. 8 shows a second separator, differently sized from the separator of FIG. 7, for forming a pocket which is of the same size and vertically displaced from the pocket formed by the separator of FIG. 7.

In an alternative embodiment illustrated in FIGS. 7 and 8, the separators may be provided in various sizes to correspond to the various pockets in the envelope.

Figure 6:
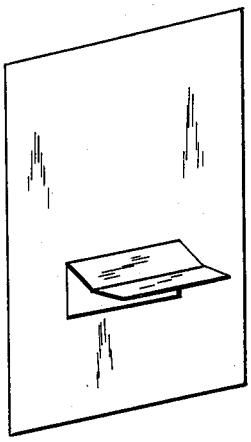
FIG. 6 shows a pocket separator incorporating a V-shaped cutout flap structure.

More specifically, vertical separators of differing sizes may be provided, each separator having a horizontal flap provided at a fixed vertical distance from its top portion. The flap may be provided in the form of a cutout, as shown at FIG. 6, or as an attachment to the separator, as shown at FIGS. 7 and 8. In either case, the flap forms a V-shaped structure at the fixed distance from the separator top. Upon adhesive or other attachment of the forward surface of the flap to the rear surface of the immediately forwardly provided separator, the desired pockets are formed to have fixed, identical, vertical depths.

As with the previously described embodiment, compression and expansion of the envelope is enhanced by provision of air passages between pockets. For the cutout flap, an air passage is provided by the cutout itself. Thus, for such an arrangement it is preferrable that the flap not extend across the entire width of the separator. For the attachment form of flap, cutout holes may be provided in the separator itself, similarly to the holes shown in FIGS. 2 and 3.

In the embodiment of FIGS. 2 and 3, the air passageways may be formed by slots or other openings in addition to the previously described holes 30.

Figure 4:
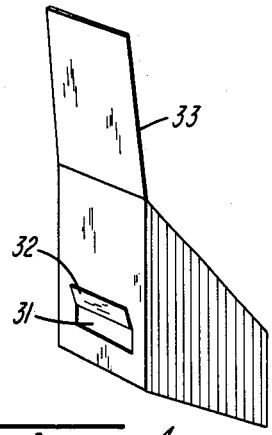
FIG. 4 shows air passages provided in an envelope according to the invention.

Additional holes or slots may be provided in the side or rear wall structure of the envelope as shown in FIG. 4, further to enhance air passage into and out of the envelope during expansion and compression thereof, respectively. For example, an opening 31 may be provided in the rear wall of the envelope and a flap 32 may be included as a cover for the opening. In that regard, it should be noted that the inventive filing receptacle may be hung on a wall by means of a hook or other attachment device (not shown) affixed to the rear wall of the envelope. Further, the filing receptacle may stand upright, using for support the cover flap 33 thereof, in a backwardly hinged position.

Although it is contemplated that an envelope in accordance with the invention may be provided with preprinted indicia 16 at the upper portions 14 of the various pockets, the envelope may be provided without such indicia and with components for enabling a user to apply his or her own indicia to the pockets.

Figure 5:
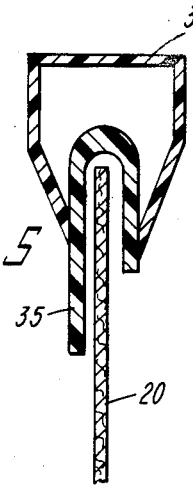
FIG. 5 shows an arrangement for affixing labels to the separator of FIGS. 2 and 3.

More specifically, there may be provided a plurality of spines, or backbone structures 34, shown in FIG. 5, for attachment of labels 35 to the separators 20. Thus, labels may be removable attached to the pockets to permit use of the envelope for various purposes to be identified by the labels.

In yet another feature of the invention, there is provided a summary of the contents of the envelope on a front face of the forward-most pocket thereof. More specifically, for a tax-record system using the envelope of the invention, on the front face 36 of the envelope there is printed a summary of tax law and requirements, summarizing the various types of expenses which may be included in each of the pockets. Thus, the pockets are individually labelled to identify the contents thereof and the front face of the envelope indicates to the user the types of permissible expenses which may be included in each pocket.

Preferably, however, the front face includes a transparent pocket 38 including therein a removable summary 40 of the type above described. Such a removable summary may be substantially more detailed than a preprinted set of instructions or summary, and may include an instruction booklet, for example, helping a user to prepare a tax return. Alternatively, for an envelope used for storage of recipes or the like, there may be provided a booklet in the pocket 38 identifying the types of recipes which may be organized together, as well as other information.

The preceding specification describes a preferred embodiment of the invention as an illustration and not a limitation thereof. It is appreciated that equivalent variations will occur to those skilled in the art. Such modifications, variations and equivalents are within the scope of the invention as recited with greater particularity in the appended claims, when interpreted to obtain the benefits of all equivalents to which the invention is fairly and legally entitled.

We claim:

1. In a multi-pocket expanding envelope, the improvement comprising, in combination:

pocket access means for enhancing ease of access to individual pockets of the envelope and content access means for enhancing ease of access to contents of said pockets, said pocket access means including means for providing vertical displacement between top portions of adjacent pockets, said contents access means including means for providing vertical displacement between bottom portions of adjacent pockets, and pocket separator means for forming and separating said pockets of said multi-pocket envelope, adjacent ones of said separator means forming said pockets, each pocket having one side formed by one separating means and another side formed by a separating means adjacent to said one separating means, said pocket separator means comprising upper portions defining said pocket access means and said top portions of said pockets, said pocket separator means further having a folding flap attached thereto, said folding flap separated by a predetermined distance from said upper portion of said pocket separator means, said folding flap forming said contents access means for defining said bottom portion of a pocket formed thereby and for providing said vertical displacement between bottom portions of adjacent pockets.

2. An improved multi-pocket expanding envelope as recited in claim 1 wherein said pocket separators include facilitating means for facilitating compression and expansion of said envelope.

3. An improved multi-pocket expanding envelope as recited in claim 2 wherein said facilitating means include means for providing air passages between adjacent pockets.

4. An improved multi-pocket expanding envelope as recited in claim 1, wherein different ones of said pocket separator means are formed of different sizes for different pockets of the envelope, whereby different pockets are provided at different vertical displacements.

5. An improved multi-pocket expanding envelope as recited in claim 1, wherein said folding flap of said pocket separator means comprises a horizontal strip of material attached to said pocket separator means at said predetermined distance from said upper portion thereof.

6. An improved multi-pocket expanding envelope as recited in claim 1, wherein said folding flap of a pocket separator means comprises a cutout tab extending from said pocket separator means.

7. An improved multi-pocket expanding envelope as recited in claim 1, wherein said pockets are formed of and separated by pocket separator means having different vertical dimensions and said flap comprises a cutout tab foldably extending from said pocket separator means.

8. An improved multi-pocket expanding envelope as recited in claim 1, wherein said pockets are formed of and separated by pocket separator means having different vertical dimensions and said flap comprises a horizontal strip of material attached to said pocket separator means at said predetermined distance from said upper portion thereof, said strip foldably extending from said separator means.

9. An improved multi-pocket expanding envelope as recited in claim 1 wherein each of said pocket separator means comprises an insert sheet inserted into said envelope for forming said pockets.

10. A multi-pocket expanding envelope comprising:

a plurality of vertical separator means for forming pockets of said envelope having top and bottom portions, and displacing means for vertically respectively displacing said top portions and bottom portions of each of said pockets from one another thereby to provide vertically displaced pockets in said envelope, said displacing means comprising a folding flap on each of said separator means for connection to an adjacent separator means and for forming a pocket between adjacent separator means, each pocket having one side formed by one separator means and another side formed by a separator means adjacent to said one separator means.

11. A multi-pocket expanding envelope as recited in claim 10 wherein said displacing means includes means for respectively displacing said top and bottom portions of said pockets by a constant distance.

12. A multi-pocket expanding envelope as recited in claim 10 wherein said vertical separator means each have a substantially constant vertical length, said separator means mounted to be vertically displaced from one another.

13. A multi-pocket expanding envelope as recited in claim 10 wherein said separator means further include facilitating means for facilitating compression and expansion of said envelope.

14. A multi-pocket expanding envelope as recited in claim 13 wherein said facilitating means include means for forming air passages between different pockets of said envelope.

15. A multi-pocket expanding envelope as recited in claim 14 further comprising surface means on an outwardly visible portion of said envelope for identifying contents and use of the pockets provided therein.

16. A multi-pocket expanding envelope as recited in claim 15 wherein said surface means comprises a transparent pocket on a forward surface of said envelope for enclosing material identifying the contents and use of the pockets.

17. A multi-pocket expanding envelope as recited in claim 10 further including identifying means for contents of said pockets, said identifying means comprising labeling means for said top portions of said pockets.

18. A multi-pocket expanding envelope as recited in claim 17 wherein said labeling means include means for removably affixing labels to said top portions of said pockets.

19. A multi-pocket expanding envelope as recited in claim 18 wherein said means for removably affixing comprises spine means for engaging said top portions of said pockets and for engaging labels to be affixed to said top portions, said spine means flexibly operable for pinching said labels and said top portions of said pockets and rigidly providing reinforcement to said top portions of said pockets.

20. A multi-pocket expanding envelope as recited in claim 10 further comprising surface means on an outwardly visible portion of said envelope for identifying contents and use of the pockets provided therein, said surface means comprising a transparent pocket on a forward surface of said envelope for enclosing material identifying the contents and use of the pockets.

21. A multi-pocket record keeping file comprising:

plural vertically displaced pocket means of substantially identical size for maintaining and storing substantially identically sized documents, said plural vertically displaced pocket means separated by inserts, said inserts forming separating means for forming adjacent pocket means and for providing separation therebetween, each pocket means having one side thereof formed by one insert and another side thereof formed by an insert adjacent to said one insert, said inserts having folding flaps forming supporting bottom portions of said pocket means operable for placing upper portions of said substantially identically sized documents within a substantially predetermined distance from top portions of said pocket means thereby to enhance access thereto.

22. A multi-pocket record keeping file as recited in claim 21 further comprising labeling means having a first means, attached to said top portions of said pocket means, for identifying contents of said pocket means, and second means, attached to said file, for identifying contents and use of said file, said second means comprising a transparent pocket attached to a visible surface of said file.

23. A multi-pocket record keeping file as recited in claim 22 wherein said first means identifies individual tax information categories for storage of records of specified categories in specified pocket means.

* * * * *